United States Patent [19]

Kawauchi et al.

[11] 3,933,321

[45] Jan. 20, 1976

[54] DEVICE FOR SIMULTANEOUSLY TRAVERSING THREAD GUIDES OF A WINDING APPARATUS FOR TAKING-UP PLURAL THREADS

[75] Inventors: Yoshikazu Kawauchi; Hiroshi Honda, both of Takahama, Japan

[73] Assignee: Kabushiki Kaisha Toyoda Jidoshokki Seisakusho, Tokyo, Japan

[22] Filed: Feb. 24, 1975

[21] Appl. No.: 552,659

[30] Foreign Application Priority Data

Feb. 27, 1974 Japan ..... 49-23461[U]

[52] U.S. Cl. ..... 242/43 R; 74/57; 74/567; 242/158.3; 242/158.5

[51] Int. Cl.[2] ..... B65H 54/30

[58] Field of Search ..... 242/43 R, 158.3, 158.5; 74/57, 59, 567

[56] References Cited

UNITED STATES PATENTS

| | | | |
|---|---|---|---|
| 3,074,286 | 1/1963 | Altice et al. | 242/43 UX |
| 3,248,064 | 4/1966 | Rollings | 242/43 |
| 3,353,761 | 11/1967 | Graf | 242/43 |
| 3,527,422 | 9/1970 | Conrad | 242/43 |
| 3,527,423 | 9/1970 | Burow | 242/43 |
| 3,792,819 | 2/1974 | Schippers | 242/43 |

*Primary Examiner*—Stanley N. Gilreath
*Attorney, Agent, or Firm*—Paul & Paul

[57] ABSTRACT

An improved traverse device of a winding apparatus for simultaneously taking-up a plurality of threads so as to simultaneously form a plurality of thread packages, the traverse device provided with a common traverse cam for creating traverse guide motion of a plurality of thread guides which are slidably mounted on a guide rail means disposed in parallel condition to a longitudinal axis of the traverse cam. The common traverse cam is provided with at least a pair of helical endless guide grooves formed on the cylindrical surface thereof and a ring shaped guide groove formed between the above-mentioned endless guide grooves. An axially inside portion of each of said endless guide grooves is connected to said ring shaped guide groove by way of an auxiliary guide groove formed on the cylindrical surface of said traverse cam. The guide rail means is provided with a cut-out portion at a position facing the ring shaped guide groove. Each thread guide is slidably engaged with one of the above-mentioned endless guide grooves separately.

4 Claims, 4 Drawing Figures

DEVICE FOR SIMULTANEOUSLY TRAVERSING THREAD GUIDES OF A WINDING APPARATUS FOR TAKING-UP PLURAL THREADS

SUMMARY OF THE INVENTION

The present invention relates to a device for simultaneously traversing thread guides of a winding apparatus for taking-up a plurality of threads, more particularly, relates to a device for simultaneously traversing thread guides of a winding apparatus comprising at least one take-up unit provided with a common cylindrical traverse cam, wherein at least a pair of endless traverse cam grooves are helically formed on the cylindrical surface thereof so that each thread guide is capable of sliding along the corresponding cam groove while traversing along the axial direction of the common cylindrical traverse cam.

The above-mentioned device for simultaneously traversing thread guides of a winding unit is hereinafter referred to as a traverse device.

It is well-known that, in the conventional traverse device, a pair of horizontal traverse guide rails are mounted on a cam box which covers a cylindrical traverse cam provided with an endless traverse cam groove helically formed on the cylindrical surface thereof, and the traverse motion of a thread guide is guided by the above-mentioned horizontal thread guide rails in such a condition that the thread guide is reciprocally displaced along a horizontal guide groove formed between the above-mentioned guide rails, while the thread guide is sliding along the traverse cam groove and, therefore, very strong shock is repeatedly imparted to the thread guide at both terminals of the traverse motion thereof. Accordingly, it is frequently necessary to change the thread guide when the thread guide is worn.

In the above-mentioned conventional traverse winder, when it is required to change the thread guide, it is inevitable to separate the traverse guide rails from the cam box. And, after mounting of a fresh thread guide on the traverse cam, very delicate adjustment of the relative positions of the traverse guide rails in parallel condition to the longitudinal axis of the traverse cam is required. Consequently, the above-mentioned change of thread guide is carried out by very troublesome and skillful manual operation.

In the winding apparatus for taking up a plurality of threads by utilizing a traverse cam unit, the traverse cam is driven at very high speed so that the above-mentioned wear of the thread guides becomes a more serious problem, because of the very troublesome exchange of the thread guides.

The principal object of the present invention is to provide a device for simultaneously traversing thread guides of a winding unit for taking-up plural threads whereby the above-mentioned problem caused by changing the thread guides is perfectly solved.

To attain the above-mentioned purpose of the present invention, the cylindrical traverse cam of the invention is provided with at least single pair of helically crossing endless traverse cam grooves, which are formed on the cylindrical surface thereof in symmetrical condition to each other, and also provided with a ring shaped guide groove formed on the cylindrical surface thereof at an intervened position between the above-mentioned pair of endless traverse cam grooves. Each traverse cam groove is connected to the ring shaped guide groove at a position adjacent to the ring shaped guide groove so as to form passages for easily displacing the thread guides from the respective endless traverse cam grooves to the ring shaped guide groove and vice-versa. Since the cylindrical traverse cam is provided with the above-mentioned particular construction, the changing operation of the thread guides can be carried out manually by simple manual operation.

DETAILED EXPLANATION OF THE INVENTION

For the sake of better understanding of the characteristic feature of the present invention, the starting point of the idea to create the present invention is firstly explained.

Figure 1:
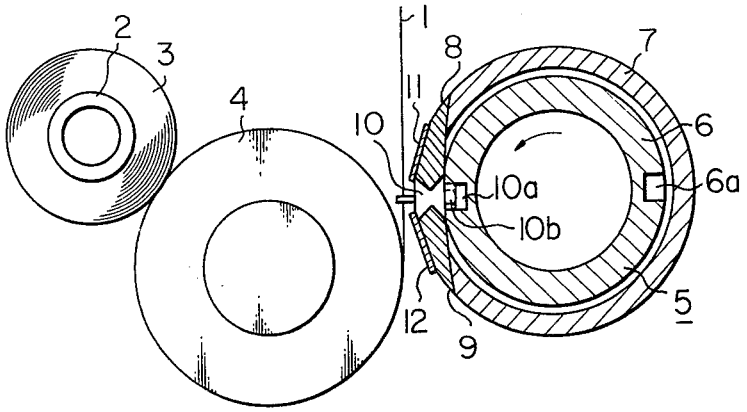
FIG. 1 is a schematic side view, partly in section, of a traverse device of a conventional winding apparatus.

Referring to FIG. 1, in the conventional traverse winding unit, a thread 1 introduced to the take-up mechanism is wound on a bobbin 2 so as to form a thread package 3 which is rotated by frictional contact with a friction roller 4. During the above-mentioned winding operation, the thread 1 is traversed along an axial direction of the friction roller 4 by means of a traverse device 5. The traverse device 5 comprises a cylindrical traverse cam 6 rotatably mounted on the frame of the winding unit in axially parallel condition to the friction roller 4, a cylindrical cam box 7 provided with a horizontal aperture at a position facing the friction roller 4, wherein the traverse cam 6 is rotatably disposed, a pair of horizontal traverse guide rails 8, 9 secured to the cylindrical cam box 7 at the horizontal edge portions of the above-mentioned aperture so that a horizontal guide groove is formed between the traverse guide rails 8 and 9, a thread guide 10 slidably engaged in the above-mentioned horizontal guide groove, and a pair of cover plates 11 and 12 secured to the traverse guide rails 8 and 9, respectively, so that the above-mentioned horizontal guide groove is protected from dust. The traverse cam 6 is provided with an endless helical guide groove **6*a*, and a roller 10*a* turnably mounted on a pin-shaft 10*b* projected from the thread guide 10 is slidably engaged in the guide groove 6*a*. Therefore, a quick traverse motion of the thread guide 10 along the above-mentioned horizontal guide groove can be created by the high speed rotation of the cylindrical traverse cam 6**.

According to the above-mentioned quick traverse motion, the thread guide 10 is worn rapidly, as already explained. Therefore, it is frequently necessary to exchange the thread guide 10 which has been worn for a fresh thread guide. However, the construction of the traverse device 5 is rather complicated for easy-changing of the thread guide 10. For instance, the traverse guide rails 8 and 9 should be removed from the cam box 7 when the used thread guide 10 is exchanged for a fresh thread guide. Since the space between the friction roller 4 and the traverse device 5 is not sufficiently large to permit the above-mentioned changing operation of the thread guide, it has been necessary to take off the traverse device 5 from the winding unit before changing the thread guides. To eliminate such troublesome operation, it has been proposed to use an auxiliary guide groove formed on the traverse cam at either axial sides thereof in such a condition that the auxiliary guide groove is offset from the endless helical guide groove 6*a* of the traverse cam 6. That is, when it is required to exchange the used thread guide for a fresh thread guide, the used thread guide is, firstly, taken from the traverse guide groove 6*a* by way of the auxiliary guide groove by turning the traverse cam and, next, a fresh thread guide is supplied to the traverse guide groove 6*a* by way of the auxiliary guide groove. Such system has been applied to the conventional traverse winder.

However, in the case the traverse winder wherein a plurality of threads are simultaneously taking-up the respective bobbins by way of the respective thread guides which are driven by a common traverse cam, since each thread guide is driven by its own helical guide groove formed on the common traverse cam, the above-mentioned operation for changing thread guides can not be applied to every thread guide.

Figure 2:
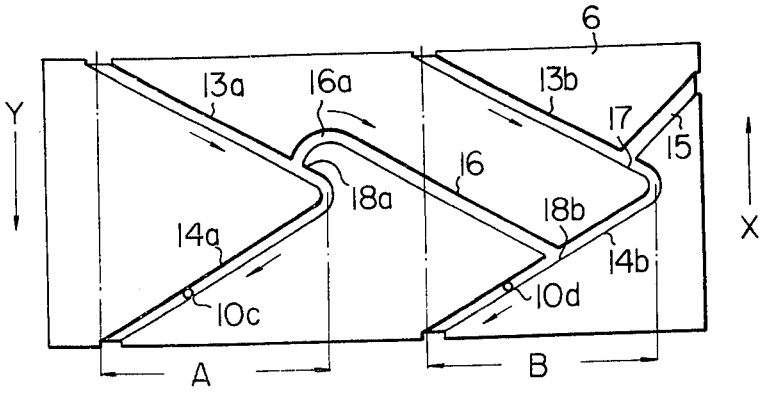
FIG. 2 is a developed view of the endless traverse cam grooves formed on a cylindrical traverse cam, which may be understood as a starting point to create the present invention.

At the beginning stage of creating the present invention, it was proposed to utilize the above-mentioned auxiliary guide groove only for the traverse guide groove 6*a* formed on either axial end portion of the common traverse cam and two adjacent endless traverse guide grooves were to be connected by a connecting guide groove. An example of this type of utilization of the common traverse cam 6 is shown in FIG. 2. In the common traverse cam 6 shown in FIG. 2, a pair of endless helical guide grooves A and B, which are identically shaped, are formed on the cylindrical surface of the cam 6.

Each guide groove A (B) is provided with a first portion 13*a* (13*b*) and a second portion 14*a* (14*b*) and the first portion and second portion are connected to each other at both ends portions thereof. When the thread guide 10*c* (10*d*) is sliding along the first portion 13*a* (13*b*), the thread guide 10*c* (10*d*) is displaced along the guide rails 8 and 9 toward the right hand direction in FIG. 2. On the other hand, the thread guide 10*c* (10*d*) is displaced along the guide rails 8 and 9 toward the left hand direction in FIG. 2 when the thread guide 10*c* (10*d*) is sliding along the second portion 14*a* (14*b*). The displacing direction of the thread guide 10*c* (10*d*) is changed at the connected portions of the first portion 13*a* (13*b*) and the second portion 14*a* (14*b*), respectively.

An auxiliary guide groove 15 is offset from the first portion 13*b* of the endless guide groove B at the position 17 adjacent to the axially end portion of the traverse cam 6 in such a condition that the inclined direction thereof is almost parallel to that of the second guide groove as shown in FIG. 2. A connecting guide groove 16 connects the first portion 13*a* of the endless guide groove A to the second portion 14*b* of the endless guide groove B in such a condition that the connecting guide groove 16 is offset from the first portion 13*a* of the endless guide groove A at a position 18*a* adjacent to the inside connecting portion which connects the first portion 13*a* to the second portion 14*a* of the endless guide groove A. The connecting guide groove 16 is then curved toward the second portion 14*b* of the endless guide groove B and connected to the middle portion 18*b* of the second portion 14*b* of the endless guide groove B. Consequently, the inclination of the connecting guide groove 16 with regard to the central axis of the common traverse cam 6 is identical to the inclination of the first portion 13*a* (13*b*). The above-mentioned curved portion of the connecting guide groove 16 is represented by a reference 16*a* in FIG. 2. During the take-up operation, the traverse cam 6 is rotated toward the X direction in FIG. 2. The traverse motion of the thread guides 10*c* and 10*d* along the axial direction of the traverse cam 6 is created, according to the above-mentioned rotation of the traverse cam 6.

When it is required to exchange the used thread guides 10*c* and 10*d* for fresh thread guides, firstly, the traverse cam 6 is turned toward the direction X shown in FIG. 2. According to the above-mentioned turning motion of the traverse cam 6, the thread guides 10*c*, 10*d* are carried from the second portions 14*a* and 14*b* of the respective helical guide grooves A and B to the first portions 13*a* and 13*b* of the respective endless guide grooves A and B, and; when these thread guides 10*c* and 10*d* are displaced to the offset portions 18*a* and 17 of the first portions 13*a* and 13*b* respectively, the traverse cam 6 is turned to the direction Y. Consequently, the thread guide 10*d* is displaced along the auxiliary groove 15 toward a free end of the groove 15 so that the thread guide 10*d* is discharged from the traverse cam 6.

On the other hand, when the thread guide 10*c* is displaced to the terminal of the curved portion 16*a*, according to the above-mentioned turning motion of the traverse cam 6 toward the Y direction, then the traverse cam 6 is turned toward the X direction again. Therefore, the thread guide 10*c* is displaced along the connecting guide groove 16 toward the middle portion 18*b* of the second portion 14*b* and then displaced along the second portion 14*b* and the first portion 13*b* of the endless guide groove B. When the thread guide 10*c* arrives at the offset portion 17 of the first portion 13*b* of the endless guide groove B, the traverse cam 6 is turned toward the direction Y and, accordingly, the thread guide 10*c* is displaced along the auxiliary groove 15 and discharged therefrom. Next a fresh thread guide is inserted into the auxiliary guide groove 15 and the traverse cam 6 is turned toward X and, accordingly, this fresh thread guide is displaced to the offset portion 17 of the first portion 13*b* of the endless guide groove B. In this condition, the traverse cam 6 is turned toward the Y direction so that the fresh thread guide is displaced along the first portion 13*b* and the second portion 14*b* of the endless guide groove B and displaced to the middle portion 18*b* of second portion 14*b*, which is the terminal of the connecting guide groove 18. In this condition, the fresh thread guide is pushed into the connecting guide groove 18 manually. Thereafter, the traverse cam 6 is turned toward the Y direction so that the fresh thread guide is displaced to the curved portion 16*a*. When the fresh thread guide arrives at the terminal of the curved portion 16*a*, the traverse cam 6 is turned toward X so that the fresh thread guide is displaced to the offset position 18*a* of the first portion 13*a* of the endless guide groove A. Thereafter, the traverse cam 6 is turned toward the Y direction so that the insertion of a fresh thread guide into the endless guide groove A is completed. Next, a second fresh thread guide is manually inserted into the auxiliary groove 15 and then the traverse cam 6 is turned toward the direction X so that the fresh thread guide is displaced to the offset position 17 of the first portion 13*b*. In this condition, the traverse cam 6 is turned to the Y direction so that the insertion of the fresh thread guide into the endless guide groove B is completed.

As mentioned above, the changing operation of the thread guide of the traverse cam 6 shown in FIG. 2 is carried out by a very complex combination of turning operations of the traverse cam 6. Further, since the traverse cam 6 is covered with the cylindrical cam box 7 provided with the guide rails 8 and 9, the confirmation of the relative positions of these thread guides 10*c*, 10*d* with respect to the endless guide grooves A and B is very difficult, particularly offset positions 17 and 18*a* and the middle position 18*b*. Accordingly, the above-mentioned changing system wherein the thread guides can be discharged from an auxiliary guide groove 15 offset from the endless guide groove B can not be practically applied to the traverse device for simultaneously taking-up plural threads by separate bobbins.

Therefore, in the present invention, the key point is how to eliminate the drawbacks of the idea shown in FIG. 2. The detailed construction of the traverse winding device according to the present invention is hereinafter explained in detail, with reference to a typical embodiment of the traverse cam and related elements thereof shown in FIGS. 3 and 4. In the traverse winding unit according to the present invention, the general construction thereof is quite similar to the traverse winding unit shown in FIG. 1, except for the construction of the traverse cam 6, the traverse guide rail 8, and the horizontal cover 11. Therefore, the constructions and functions of elements similar to the elements of the conventional traverse winder shown in FIG. 1 are not explained in the following explanation of the traverse device according to the present invention, and they are represented by reference numerals identical to the those of the traverse winder shown in FIG. 1.

Figure 3:
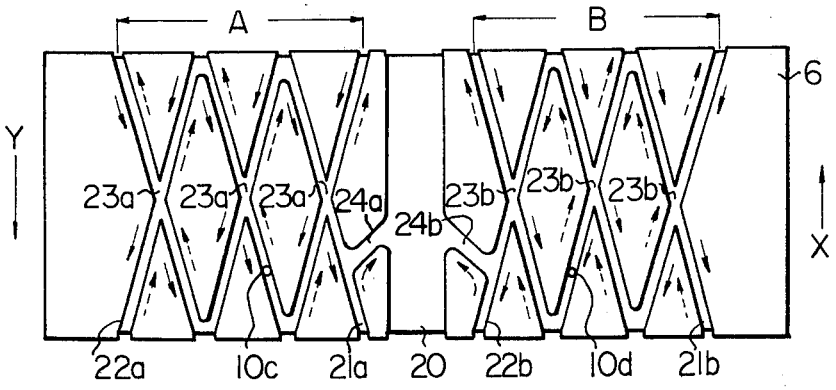
FIG. 3 is a developed view of the endless traverse cam grooves formed on a cylindrical traverse cam according to the present invention.

Referring to FIG. 3, the common traverse cam 6 is provided with a pair of endless helically crossing endless guide grooves A and B which are endless guide grooves for creating the traverse motions of two thread guides 10 along the axial direction of the common traverse cam 6. To identify the above-mentioned threads guides 10, the thread guide for the guide groove A and the thread guide for the guide groove B are identified as 10*c* and 10*d*, respectively. A ring-shaped guide groove 20 is formed on the cylindrical surface of the cam 6 at a position between the helically crossing endless guide grooves A and B. The shapes of said helically crossing endless guide grooves A and B are symmetrically formed with respect to the ring-shaped guide groove 20. Said helically crossing guide groove A comprises a combination of a helical guide groove 21*a* and a helical guide groove 22*a* which crosses the guide groove 21*a* at crossing points 23*a*, while said helical guide groove B comprises a combination of helical guide groove 21*b* and a helical guide groove 22*b* which crosses said guide groove 21*b* at crossing points 23*b*. The ends of helical guide grooves 21*a* and 22*a* are connected to each other, while the ends of helical guide grooves 21*b* and 22*b* are connected to each other. Said helical guide groove 21*a* is connected to the ring-shaped guide groove 20 by an auxiliary guide groove 24*a* which is offset from the inside portion of the helical guide groove 21*a*, while the helical guide groove 22*b* is connected to the ring-shaped guide 20 by an auxiliary guide groove 24*b* which is offset from the inside portion of the helical guide groove 22*b*, as shown in FIG. 3.

Each roller 10*a* of the thread guides 10*c* and 10*d* is rotatably engaged in the above-mentioned guide grooves A and B, respectively (FIGS. 2 and 3). The ring-shaped guide groove 20 is provided with a width more than twice the diameter of the roller 10*a*, while the width of the auxiliary guide grooves 24*a* and 24*b* are also larger than the roller 10*a* of the thread guides 10*c* and 10*d*.

Therefore, when the traverse cam 6 is rotated toward the direction represented by an arrow X in FIG. 3, the thread guides 10*c* and 10*d* slide along the helical crossing endless guide grooves A and B, respectively, toward directions represented by solid line arrows. Since these thread guides 10*c* and 10*d* are restricted in their motions by the guide rails 8 and 9, when the thread guides 10*c* and 10*d* slide along the helical grooves 21*a* and 21*b*, respectively, said thread guides 10*c* and 10*d* are displaced toward the right in FIG. 3. On the other hand, when the thread guides 10*c* and 10*d* slide along the helical grooves 22*a* and 22*b* respectively, said thread guides 10*c* and 10*d* are displaced toward the left in FIG. 3. Consequently, the traverse movements of these thread guides 10*c* and 10*d* are created.

When it is required to remove the used thread guides 10*c* and 10*d* from the endless guide grooves A and B, respectively, the traverse cam 6 is turned in the direction opposite to the normal running direction of the traverse cam 6. This turning direction is represented by Y in FIG. 3.

According to the above-mentioned turning of the traverse cam 6 in the Y direction, the thread guides 10*c* and 10*d* are introduced into the guide grooves 21*a* and 22*b* respectively as shown by the broken line arrows, and then introduced into the auxiliary guide grooves 24*a* and 24*b*, respectively, and finally introduced into the ring-shaped guide groove 20. In this way, these thread guides 10*c* and 10*d* can be easily removed from the right-shaped guide groove 20.

Figure 4:
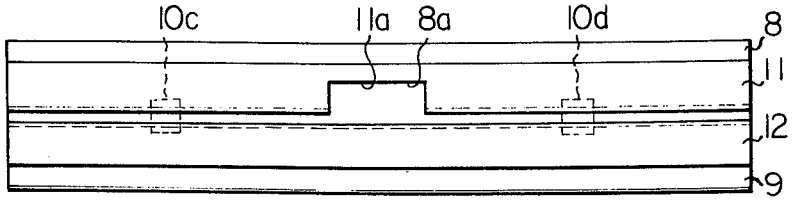
FIG. 4 is a schematic front view of the guide rails mounted on the cam box, according to the present invention.

However, it is necessary for the ring-shaped guide groove 20 to hole thread guides 10*c* and 10*d* in the guide groove 20 until the manual operation of removing these thread guides 10*c* and 10*d* from the traverse cam 6 is completed. To attain the above-mentioned function, the thread guide rails 8 and the cover plate 11 are provided with cut out portions 8*a* and 11*a* formed at positions facing the ring-shaped guide groove 20, as shown in FIG. 4. The opened spaces of these cut-off portions 8*a* and 11*a* are large enough to permit the free escape of these thread guides 10*c* and 10*d* therefrom.

When it is required to change the used thread guides 10*c* and 10*d* for fresh ones, firstly the driving motor (not shown) is stopped so as to stop the rotation of the traverse cam 6. Next, the traverse cam 6 is turned in the opposite direction to the normal running direction. The thread guides 10*c* and 10*d* slide along the guide grooves A and B in their respective directions represented by the broken line arrows in FIG. 3. They are then introduced into the inside portions of the respective guide grooves 21*a* and 22*b*, which are thereafter introduced into the auxiliary guide grooves 24*a* and 24*b*, respectively. These thread guides 10*c* and 10*d* are introduced into the ring-shaped guide groove 20 by a further turning motion of the traverse cam 6. Since the thread guide rail 8 and the cover 11 are provided with the cut-out portions 8*a* and 11*a* facing to the guide groove 20, these thread guides 10*c* and 10*d* can be manually removed through said cutout portions 8*a* and 11*a*.

Next, the rollers 10*a* of the new thread guides are placed in the ring-shaped guide groove 20 through said above-mentioned cut-out portions 8*a* and 11*a* and, thereafter, the traverse cam 6 is turned in the normal running direction while said new thread guides are urged toward the guide grooves A and B, respectively. When the entrance of the auxiliary guide grooves 24*a* and 24*b* face these thread guides, these thread guides are introduced therein and, thereafter, are introduced into the guide grooves 21*a* and 22*b*, respectively, by the further turning of the traverse cam 6.

Since the cam box 7 is capable of turning about the axis of the traverse cam 6, even if a thread is jammed between the friction roller 4 and either one of the thread guides 10*a* and 10*b*, the jammed thread can be easily released from the troubled position between the friction roller 4 and the thread guide 10*c* (10*d*) so that the durability of the thread guides 10*c* (10*d*) can be prolonged.

Since it is not required to separate the thread guide rails 8 and 9 from the cam box 7 when the thread guide changing operation is carried out, the parallel disposition of the thread guide rails 8 and 9 is always maintained so that any troublesome adjustment to dispose the guide rails 8 and 9 in parallel condition, which is inevitable in the conventional traverse device, is perfectly eliminated, according to the present invention.

Further, it is a practical advantage of the traverse device according to the present invention that, since at least a pair of helically crossing guide grooves A and B are symmetrically formed on the cylindrical surface of the traverse cam 6 with respect to the ring-shaped guide groove 20, so as to simultaneously pick up the thread guides 10*c* and 10*d* through the ring-shaped guide groove 20 by turning the traverse cam toward the opposite direction to the normal running direction thereof, the thread guide changing operation can be carried out very easily in a remarkably shortened time in comparison with the case of utilizing the conventional traverse device wherein the relative position of the thread guide rails to the traverse cam is fixed.

The above-mentioned embodiment may be modified within the spirit of the present invention, for example, the shape of the guide grooves A and B, etc., may be modified within the spirit of the present invention defined by the claims. In the above-mentioned embodiment, the cam box 7 is a cylindrical one provided with a horizontal aperture for forming traverse guide groove and the cam box 7 is concentrically disposed to the traverse cam 6. However, a cylindrical cam box 7 having a larger diameter than the above-mentioned embodiment may be disposed in eccentric condition with respect to the axial center of the traverse cam 5, without any drawbacks in comparison with the above-mentioned embodiment of the present invention.

What is claimed is:

1. In a winding apparatus for simultaneously taking up a plurality of threads, provided with a common friction roller for rotating a plurality of bobbins or thread packages formed on said bobbins and a traverse device disposed at a position adjacent to said friction roller, an improved traverse device comprising a cam box provided with a horizontal aperture formed at a part thereof in parallel condition to a longitudinal axis of said friction roller, a pair of thread guide rails secured to edge portions of said horizontal aperture of said cam box in parallel condition to said aperture, at least a pair of thread guides slidably disposed in a space formed between said guide rails, a common cam rotatably held in said cam box in axially parallel condition to said aperture of said cam box; said common traverse cam provided with at least a pair of helical endless guide grooves formed on a cylindrical surface thereof and provided with a ring shaped guide groove formed on said cylindrical surface thereof at an intervened position between said helical endless guide grooves and provided with a pair of auxiliary guide grooves connecting axially inside portions of said endless guide grooves to said ring shaped guide groove, respectively, one of said guide rails provided with a cut-out portion formed at a central portion thereof facing said ring shaped guide groove, said thread guides slidably engaged in either one of said guide grooves of said common traverse cam, respectively.

2. An improved traverse device according to claim 1, further comprising a pair of cover plates secured to said thread guide rails, respectively, in parallel condition to said thread guide rails, one of said cover plates provided with a cut-out portion formed at a middle portion thereof in superimposed relationship to said cut-out portion of said thread guide rail.

3. An improved traverse device according to claim 1, wherein each of said endless guide grooves of said traverse cam comprises axially crossing helical endless guide grooves formed on said cylindrical surface of said traverse cam.

4. An improved traverse device according to claim 1, wherein said helical endless guide grooves are provided with axially symmetrical shapes with respect to said ring shaped guide groove.

* * * * *